United States Patent [19]

Owens

[11] 4,456,543

[45] Jun. 26, 1984

[54] BISBIGUANIDE BASED ANTIBACTERIAL CLEANSING PRODUCTS

[75] Inventor: James W. Owens, Memphis, Tenn.

[73] Assignee: The Buckeye Cellulose Corporation, Cincinnati, Ohio

[21] Appl. No.: 389,196

[22] Filed: Jun. 17, 1982

[51] Int. Cl.[3] ..... C11D 1/50; C11D 3/48

[52] U.S. Cl. ..... 252/106; 252/DIG. 14

[58] Field of Search ..... 252/106, 541, 174.21, 252/174.22, DIG. 14; 424/326

[56] References Cited

U.S. PATENT DOCUMENTS

| | | | |
|---|---|---|---|
| 2,677,700 | 5/1954 | Jackson et al. | 260/488 |
| 2,684,924 | 7/1954 | Rose et al. | 424/326 |
| 2,828,345 | 3/1958 | Spriggs | 260/615 |
| 2,830,006 | 4/1958 | Birtwell et al. | 252/106 |
| 2,979,528 | 4/1961 | Lundsted | 260/584 |
| 3,468,898 | 9/1969 | Cutler et al. | 260/301 |
| 3,539,520 | 11/1970 | Cantor et al. | 252/106 |
| 3,855,140 | 12/1974 | Billany et al. | 252/106 |
| 3,960,745 | 6/1976 | Billany et al. | 252/106 |
| 4,059,687 | 11/1977 | Bauman | 424/54 |
| 4,326,977 | 4/1982 | Schmolka | 252/106 |

FOREIGN PATENT DOCUMENTS 3999 9/1979 European Pat. Off. .

*Primary Examiner*—P. E. Willis, Jr.

*Attorney, Agent, or Firm*—Milton B. Graff, IV; John V. Gorman; Richard C. Witte

[57] ABSTRACT

Antibacterial cleansing products comprise from about 0.001% to about 50% of a bisbiguanide bactericidal substance, and from about 0.05% to about 99% of specific nonionic surfactants.

11 Claims, No Drawings

BISBIGUANIDE BASED ANTIBACTERIAL CLEANSING PRODUCTS

TECHNICAL FIELD

This invention relates to antibacterial cleansing products and, more specifically, to cleansing products incorporating nonionic surfactants and bisbiguanide bactericidal substances.

BACKGROUND OF THE INVENTION

Antibacterial cleansing products have many potential uses for simultaneous cleaning and disinfecting a wide variety of materials, objects, living organisms, and the like. The current invention is concerned primarily with antibacterial cleansing products used as surgical scrubs to clean and disinfect items including the hands and arms of operating room personnel prior to the performance of surgical procedures and the skin surface of patients relevant to such procedures.

Bisbiguanide bactericidal substances, exemplified by chlorhexidine, are well known antibacterial agents; chlorhexidine is currently used in commercial surgical scrub products. It is a desirable antibacterial agent for such products because it has a broad spectrum of activity combined with good toxicity and mildness characteristics. Also, chlorhexidine is substantive to the skin and thus provides a persistant antibacterial action. However, chlorhexidine's antibacterial activity is greatly reduced in the presence of many surfactants. It has generally been found that anionic surfactants substantially reduce the antibacterial activity of chlorhexidine and that cationic surfactants are too irritating to be used in surgical scrub products. It has also been found that many nonionic surfactants substantially reduce the antibacterial activity of chlorhexidine. U.S. Pat. No. 2,830,006 issued to Birtwell & Rose on Apr. 8, 1958, discloses that bisbiguanide bactericidal substances are advantageously combined with certain nonionic surfactants to form products having valuable fungicidal, bactericidal and detergent properties. U.S. Pat. Nos. 3,855,140 and 3,960,745 both issued to Billany, Longworth & Shatwell on Dec. 17, 1974, and June 1, 1976, respectively, disclose particular nonionic detergents with which chlorhexidine retains a substantial amount of antibacterial activity.

SUMMARY OF THE INVENTION

The invention described herein is an antibacterial cleansing product comprising from about 0.001% to about 50% of a bisbiguanide bactericidal substance, and from about 0.05% to about 99% of a surfactant from the group consisting of the following substances:

(1) a first surfactant of the general chemical structure:

$$H(CH_2)_xO(C_3H_6O)_a(C_2H_4O)_bH$$

wherein x is a number from about 1 to about 10, a is a number such that the average molecular weight of the polyoxypropylene portion is at least about 370, and b is a number such that the average molecular weight of the polyoxyethylene portion is from about 25% to about 95% of the average molecular weight of said first surfactant;

(2) a second surfactant of the general chemical structure:

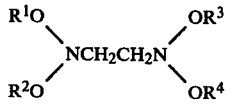

wherein each $R^1$, $R^2$, $R^3$ and $R^4$ group has the following chemical structure:

$$-(C_3H_6O)_c(C_2H_4O)_dH$$

wherein c and d are numbers such that the average molecular weight of the combined polyoxypropylene portions is from about 500 to about 25,000, and such that the average molecular weight of the combined polyoxyethylene portions is from about 20% to about 90% of the average molecular weight of said second surfactant;

(3) a third surfactant of the general chenical structure:

$$HO(C_2H_4O)_e(C_4H_8O)_f(C_2H_4O)_gH$$

wherein f is a number such that the average molecular weight of the polyoxybutylene portion is at least about 1,000, and e and g are numbers such that the average molecular weight of the combined polyoxyethylene portions is from about 20% to about 90% of the average molecular weight of said third surfactant; and (4) mixtures thereof.

It is an object of the present invention to provide antibacterial cleansing compositions containing a bisbiguanide bactericidal substance and nonionic surfactant compatible therewith.

It is a further object of the present invention to provide such antibacterial cleansing compositions having antibacterial activity in conjunction with good lathering characteristics.

It is a still further object of the present invention to provide such antibacterial cleansing compositions also having good skin mildness characteristics.

DETAILED DESCRIPTION OF THE INVENTION

This invention relates to antibacterial cleansing products that utilize a combination of at least one bisbiguanide bactericidal substance and certain nonionic surfactants to achieve a composition which retains a substantial portion of the antibacterial activity of the bisbiguanide bactericidal substance. The antibacterial cleansing products of this invention contain the combination of bisbiguanide bactericidal substance and nonionic surfactant either with or without under additives. The form of such products can be a liquid or semi-solid aqueous-based formulation, dried granular product, or other dry combination of the ingredients.

The preferred antibacterial cleansing products of this invention are aqueous-based formulations containing chlorhexidine and certain nonionic surfactant(s). These preferred products are liquid or semi-solid concentrate products which are generally utilized like a liquid soap product with additional water to cleanse the skin. Other optional ingredients in the antibacterial cleansing products include amine oxide surfactant, amphoteric and zwitterionic surfactant, alkyl diethanolamine surfactant, chelating agent, preservative, coloring agent, and fragrance.

The Bisbiguanide Bactericidal Substance

Bisbiguanide bactericidal substances include chemical compounds represented by the generic formula:

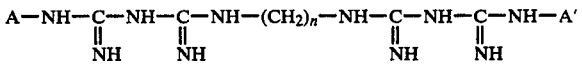

(1)

wherein A and A' are alkyl radicals or phenyl radicals which are substituted by alkyl, alkoxy, nitro or halogen moieties and wherein A and A' may be the same or different, and wherein n is a number from 3 to 9 inclusive and wherein the polymethylene chain can be interrupted by oxygen atoms and/or by aromatic nuclei. Bisbiguanide bactericidal substances are disclosed in U.S. Pat. Nos. 2,684,924 issued to Rose & Swain on July 27, 1954; 3,468,898 issued to Cutler & Schalit on Sept. 23, 1969; and 4,059,687 issued to Bauman on Nov. 27, 1977; all of which are incorporated herein by reference. The preferred bisbiguanide bactericidal substance used in the present invention is 1:6-di-($N_1$:$N_1$'-p-chlorophenyldiguanido-$N_5$:$N_5$')-hexane, chlorhexidine.

In order to be effective as a disinfectant in the antibacterial cleansing products of the present invention, salts of the bisbiguanide bactericial substances that are soluble in the aqueous-based formulations, e.g. digluconate, acetate, etc., are preferred. Chlorhexidine as the digluconate salt is especially preferred for formulations of the present invention; it is available commercially from Lonza, Inc. of Fair Lawn, N.J.

The concentration of bisbiguanide bactericidal substance in the antibacterial cleansing products of the present invention can be from about 0.01% to about 50% in dry formulations, and from about 0.001% in dilute aqueous formulations to about 10% in concentrated aqueous formulations. The concentration of the preferred chlorhexidine salts in the preferred aqueous-based formulations is preferably from about 0.1% to about 10%, more preferably from about 1% to about 5%.

Procedure for Determining Compatibility of Chlorhexidine and Surfactant

In aqueous solution, chlorhexidine associates with many surfactants to form a complex; this results in a substantial reduction of the antibacterial activity of the chlorhexidine. The following procedure was used to measure the relative tendency of chlorhexidine to form such complexes with surfactants:

(a) 20 ml of a solution containing 20% (wt/vol) of chlorhexidine digluconate is added to 80 ml of an aqueous sample containing 10 grams of a test surfactant; this mixture is thoroughly mixed.

(b) 5 ml of the mixture from step (a) is placed in dialysis tubing having a 1,000 molecular weight cut-off (e.g. Spectra Por 6 from Spectrum Medicial Industries, Inc., Los Angeles, Calif.); both ends of the tubing are securely tied. The filled tubing is placed in 40 ml of water in a 50 ml cylinder and stirred on a magnetic stirrer for 20 hours. The bag is removed from the cylinder and rinsed quickly with water.

(c) Samples of both the solution remaining in the dialysis tubing and the water in the cylinder are sampled and assayed for chlorhexidine content by the method published in Holbrook, *Journal of Pharmaceutical Pharmacology,* Vol. 10, pages 370–374 (1958).

(d) The fraction of complexed chlorhexidine is determined by subtracting the concentration of chlorhexidine in the cylinder from the concentration of chlorhexidine in the tubing and dividing the difference by the concentration of chlorhexidine in the tubing:

$$\text{\% chlorhex. complexed} = \frac{[\text{chlorhex.}]_{tubing} - [\text{chlorhex.}]_{cyl.}}{[\text{chlorhex.}]_{tubing}} \times 100$$

The Nonionic Surfactant

There are three types of nonionic surfactants which when combined with chlorhexidine have been found to have a relatively high level of available chlorhexidine as determined by the procedure described hereinabove. The available chlorhexidine (100—% chlorhexidine complexed) in solutions containing these surfactants is generally greater than 50% and is sometimes greater than 70%.

One type of surfactant that has been found to have such compatibility with chlorhexidine has the following general chemical structure:

$$H(CH_2)_xO—PO—EO—H \quad (2)$$

wherein PO is polyoxyproyplene:

$$—(C_3H_6O)_a— \quad (3)$$

and EO is polyoxyethylene:

$$—(C_2H_4O)_b— \quad (4)$$

For chemical structure (2), x can be a number from about 1 to about 10, preferably from about 2 to about 6, more preferably about 4. The surfactant is typically a mixture of molecules of this general structure having varying molecular weights.

For the PO portion (3) of surfactant chemical structure (2), a is a number such that the PO portion has an average molecular weight of at least about 370, preferably from about 1,000 to about 2,500, more preferably from about 1,200 to about 1,500. The PO portion of the surfactant chemical structure can contain up to about 15% oxyethylene moieties rather than oxypropylene moieties.

For the EO portion (4) of surfactant chemical structure (2), b is a number such that the EO portion has an average molecular weight of from about 25% to about 95% of the average molecular weight of the chemical structure, preferably from about 40% to about 75%. The EO portion of the surfactant chemical structure can contain up to about 10% oxypropylene moieties in place of oxyethylene moieties.

Surfactants having general chemical structure (2) are disclosed in U.S. Pat. No. 2,677,700 issued to Jackson & Lundsted on May 4, 1954, which is incorporated herein by reference. Some surfactants of this general chemical structure are marketed by the Union Carbide Company, Danbury, Conn., under the tradenames of "Tergitol XD" and "Tergitol XH." The molecular weight of the PO portions of the chemical structure average about 1100 for both Tergitol XD and Tergitol XH; their total molecular weights average about 2300 and 3500, respectively.

The second type of nonionic surfactant found to be compatible with chlorhexidine has the following general chemical structure:

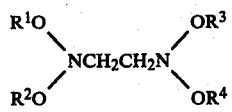

(5)

wherein each $R^1$, $R^2$, $R^3$ and $R^4$ group has the structure:

$$-PO-EO-H \quad (6)$$

or $$-(C_3H_6O)_c-(C_2H_4O)_d-H \quad (7)$$

The surfactant is typically a mixture of molecules of this general structure having varying molecular weights.

The values of c for $R^1$, $R^2$, $R^3$ and $R^4$ are such that the molecular weight of the combined PO portions of surfactant chemical structure (5) is an average of from about 500 to about 25,000, preferably from about 1,500 to about 6,000; more preferably from about 2,000 to about 3,500. The values of d for $R^1$, $R^2$, $R^3$ and $R^4$ are such that the molecular weight of the combined EO portions of surfactant chemical structure (5) is an average of from about 20% to about 90% of the average molecular weight of the chemical structure, preferably from about 25% to about 75%. In chemical structure (5), the PO portions may contain up to about 10% oxyethylene moieties and the EO portions may contain up to about 10% oxypropylene moieties.

Surfactants having general chemical structure (5) shown above are disclosed in U.S. Pat. No. 2,979,528 issued to Lundsted on Apr. 11, 1961, which is incorporated herein by reference. Some surfactants having general chemical structure (5) are available from BASF Wyandotte Corporation, Wyandotte, Mich., under the tradename "Tetronic." Examples of such surfactants are Tetronic 704 and Tetronic 707 both of which have molecular weights of the combined PO portions of the chemical structure which average from about 2500 to about 3000; the total molecular weight of Tetronic 704 averages about 4200, and that of Tetronic 707 averages about 8400.

The third type of nonionic surfactant found to be compatible with chlorhexidine has the following general chemical formula:

$$HO-EO-BO-EO-H \quad (8)$$

or $$HO-(C_2H_4O)_e-(C_4H_8O)_f-(C_2H_4O)_g-H \quad (9)$$

wherein BO is a polyoxybutylene. The surfactant is typically a mixture of molecules of this general structure having varying molecular weights.

For chemical structure (8) above, f is a number such that the average molecular weight of the BO portion of the chemical structure is at least about 1,000, preferably from about 1,200 to about 2,000; and e and g are numbers such that the combined EO portions of the chemical structure have an average molecular weight that is from about 20% to about 90% of the average molecular weight of the surfactant chemical structure, preferably from about 60% to about 90%. Impurities in the BO and EO portions of chemical structure (8) can occur wherein such impurities consist primarily of up to about 10% moieties of the other portion of the structure.

Surfactants having general chemical structure (8) shown above are disclosed in U.S. Pat. No. 2,828,345 issued to Spriggs on Mar. 25, 1958, which is incorporated herein by reference.

The quantity of surfactant in the antibacterial cleansing products of the present invention can be from about 0.5% to about 99% in dry formulations, and from about 0.05% in dilute aqueous formulations to about 50% in concentrated aqueous formulations. The quantity of surfactant in the preferred aqueous-based concentrate formulations is preferably from about 5% to about 35%, more preferably from about 10% to about 30%.

Additional Surfactants

The three types of nonionic surfactants described hereinabove have good mildness characteristics but are relatively low lathering surfactants. In order to boost the lathering characteristics of the skin cleansing products of the present invention, other surfactants can be added to the product formulation. These other surfactants can constitute from 0% to about 30% of the surfactants in the antibacterial cleansing products of the present invention; preferably they constituted from 0% to about 10% of the preferred aqueous-based products.

A preferred group of other surfactants which can be included in the product formulations of this invention are amine oxide; amphoteric and zwitterionic; and alkylmonoethanol, diethanol, isopropanol, and ammonia amide surfactants.

An example of preferred amine oxide surfactants of interest in the present invention correspond to the following general formula:

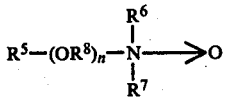

wherein $R^5$ is an alkyl radical of from about 8 to about 24 carbon atoms; $R^6$ and $R^7$ are each $C_1$–$C_4$ alkyl radicals (e.g. methyl or ethyl radicals), $C_1$–$C_4$ hydroxy alkyl radicals (e.g. hydroxyethyl radicals), or polyethoxy (2–10) groups which can be attached through an —O— or —N= or

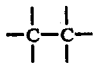

links to form heterocyclic chains; $R^8$ is ethylene and/or glyceryl; and n is a number from 0 to about 10. The arrow in the formula is a conventional representation of a semi-polar bond.

Another example of preferred amine oxide surfactants of interest in the present invention are alkyl amido amine oxides which correspond to the following general formula:

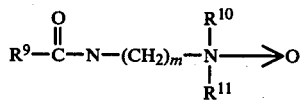

wherein $R^9$ is an alkyl radical of from about 7 to about 23 carton atoms, $R^{10}$ and $R^{11}$ are each methyl, ethyl, or hydroxyethyl radicals, and m is a number from about 2 to about 4.

Examples of amine oxide surfactants preferred for incorporation in the antibacterial cleansing products of the present invention include myristyldimethylamine oxide and lauryldimethylamine oxide.

The amine oxide surfactant can constitute from 0% to about 4% by weight of the preferred aqueous-based antibacterial cleansing product formulations of the present invention; preferably it constitutes from 0% to about 2% of such formulations. Increasing the amine oxide surfactant content beyond this preferred range diminishes the skin mildness of the formulations while providing little added lathering characteristics. Higher levels of amine oxide surfactant also result in lower available chlorhexidine levels.

Amphoteric synthetic surfactants of interest in the present invention can be broadly described as derivatives of aliphatic secondary and tertiary amines, in which the aliphatic radical may be straight chain or branched and wherein one of the aliphatic substituents contains from about 8 to 18 carbon atoms and one contains an anionic water solubilizing group, e.g., carboxy, sulfo, sulfato, phosphato, or phosphono. Zwitteronic synthetic surfactants can be broadly described as derivatives of quaternary ammonium, phosphonium, and sulfonium compounds, in which the aliphatic radical may be straight chain or branched, and wherein one of the aliphatic substituents contains from about 8 to 18 carbon atoms and at least one contains an anionic water solubilizing group, e.g. carboxy, sulfo, sulfato, phosphato, or phosphono.

Amphoteric and zwitterionic surfactants vary in their degree of complexing with chlorhexidine; some combine with chlorhexidine to form insoluble residues. For this reason, amphoteric and zwitterionic surfactants with a high level of free chloride ion are not preferred, especially in combination with chlorhexidine digluconate. The preferred amphoteric and zwitterionic surfactants contain carboxy water-solubilizing groups. Examples of zwitterionic surfactants preferred for incorporation in the antibacterial cleansing products of the present invention include laurylbetaine and cocobetaine. Another preferred zwitterionic surfactant is Miranol C2MSF available commercially from Miranol Chemical Company, Irvington, N.J.; its chemical structure is as follows:

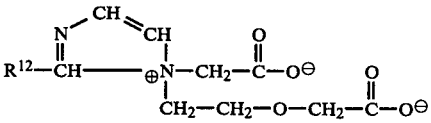

wherein $R^{12}$ is a $C_{10}$–$C_{11}$ alkyl radical.

Amphoteric and zwitterionic surfactants can constitute from 0% to about 2% by weight of the preferred aqueous-based antibacterial cleansing product formulations, but in no case should the amphoteric surfactant content be greater than about half the chlorhexidine content. The preferable amphoteric surfactant content is from 0% to about 1% of such preferred formulations.

The monoethanol, diethanol, isopropanol, and ammonia amides of fatty acids having an acyl moiety of from about 8 to about 18 carbon atoms are of interest in the antibacterial cleansing products of the present invention.

The acyl moieties are normally derived from naturally occurring glycerides, e.g., coconut oil, palm oil, soybean oil and tallow, but can be derived synthetically, e.g., by the oxidation of petroleum, or by hydrogenation of carbon monoxide by the Fischer-Tropsch process. Such surfactants preferred for incorporation in the antibacterial cleansing products of the present invention include cocodiethanolamide and lauryldiethanolamide. It is important that such surfactants incorporated in products of the present invention are free of fatty acids which could react with chlorhexidine to form insoluble residues.

Alkyl monoethanol, diethanol, isopropanol, and ammonia amide surfactants may constitute from 0% to about 2% by weight of the preferred aqueous-based antibacterial cleansing product formulations of the present invention; they preferably constitute from 0% to about 1% of such formulations.

Optional Ingredients

The antibacterial cleansing products of the present invention are preferably formulated as aqueous-based liquid products. These liquid products preferably contain from about 60% to about 80% water. The antibacterial cleansing products of the present invention can be further diluted with water prior to use such that the water content of the products is up to greater than 99%.

Perfumes may be used in formulating the antibacterial cleansing products of the present invention; colorants may also be used. Preservatives such as EDTA, methyl p-hydroxybenzoate, propyl p-hydroxybenzoate, Germall 115, Kathon (e.g. Kathon CG available commercially from Rohn and Haas Corporation which is a mixture of two isothiazolinones), etc., may be incorporated to prevent microbiological growth in the products. Metal ion chelating agents, for example, N-hydroxyethylethylenediaminetriacetate (sodium salt), etc., may be incorporated to improve the cleansing properties of the products in hard water.

Method of Manufacture

The antibacterial cleansing products of the present invention may be produced in many different forms such as dried granules, flakes, etc. as are well known in the cleansing products industry. A method of making preferred liquid antibacterial cleansing products of the present invention is described in Example I which follows.

Industrial Applicability

The antibacterial cleansing products of the present invention are designed primarily for the cleansing and disinfecting of human skin; they are expected to be used especially as scrub and skin preparation products prior to surgical procedures.

The following examples will illustrate the invention, but are not intended to be in any way limiting thereof.

EXAMPLE I

| Component | Amount (wt/vol %) |
|---|---|
| Tergitol XH | 27 |
| chlorhexidine digluconate | 4 |
| myristyldimethylamine oxide | 1.8 |
| cocobetaine | 0.8 |
| lauryldiethanolamide | 0.8 |
| ammonium hydroxide | to pH 6.7 |
| water | balance |

An antibacterial cleansing product of the above composition can be produced by a batch process comprising the following steps:

(a) Appropriate quantities of concentrated solutions of chlorhexidine digluconate, amine oxide surfactant (myristyldimethylamine oxide), and zwitterionic surfactant (cocobetaine) are added to about two-thirds of the water in a mixing container; these ingredients are agitated until well mixed.
(b) The mixture of step (a) is heated in the container to 45° C.
(c) The Tergitol XH is melted and slowly added to the mixture of step (b) with agitation.
(d) The lauryldiethanolamide is melted and slowly added to the mixture of step (c) with agitation.
(e) Agitation continues with the temperature held at 45° C. until the Tergitol and lauryldiethanolamide are completely dissolved.
(f) The solution is cooled to room temperature.
(g) Perfumes, colorants, preservatives, and chelating agents, if any, are added with agitation until dissolved.
(h) Base (ammonium hydroxide) is added with agitation until the pH of the solution is 6.7.
(i) The volume of solution is adjusted to the final batch quantity by the addition of water.

EXAMPLE II

| Component | Amount (wt/vol %) |
|---|---|
| Tetronic 704 | 25 |
| chlorhexidine digluconate | 4 |
| lauryldimethylamine oxide | 2 |
| cocobetaine | 1 |
| N—hydroxyethylethylene-diaminetriacetate (sodium salt) | 0.1 |
| methyl p-hydroxybenzoate | 0.3 |
| propyl p-hydroxybenzoate | 0.1 |
| ammonium hydroxide | to pH 6.7 |
| water | balance |

An antibacterial cleansing product is made with the composition above using the process described in Example I except that heating of the solution is not needed to dissolve Tetronic 704 unless the solution temperature is under 20° C.

EXAMPLE III

| Component | Amount (wt/vol %) |
|---|---|
| Tergitol XD | 20 |
| chlorhexidine digluconate | 4 |
| Miranol C2MSF | 1 |
| cocodiethanolamide | 4 |
| ammonium hydroxide | to pH 6.7 |

-continued

| Component | Amount (wt/vol %) |
|---|---|
| water | balance |

An antibacterial cleansing product is made with the composition above using the process described in Example I.

EXAMPLE IV

| Component | Amount (wt/vol %) |
|---|---|
| Tergitol XH | 10 |
| chlorhexidine digluconate | 4 |
| laurylbetaine | 1 |
| lauryldiethanolamide | 3 |
| Kathon CG | 0.01 |
| ammonium hydroxide | to pH 6.7 |
| water | balance |

An antibacterial cleansing product is made with the composition above using the process described in Example I.

EXAMPLE V

| Component | Amount (wt/vol %) |
|---|---|
| Tergitol XH | 10 |
| chlorhexidine digluconate | 4 |
| myristyldimethylamine oxide | 2 |
| laurylbetaine | 1 |
| Kathon CG | 0.01 |
| ammonium hydroxide | to pH 6.7 |
| water | balance |

An antibacterial cleansing product is made with the composition above using the process described in Example I.

While particular embodiments of the present invention have been illustrated and described, it wouuld be obvious to those skilled in the art that various changes and modifications can be made without departing from the spirit and scope of the invention. It is intended to cover, in the appended claims, all such modifications that are within the scope of this invention.

What is claimed is:

1. An antibacterial cleansing product comprising:
(a) from about 0.001% to about 10% of a salt of chlorhexidine whicn is soluble in said product;
(b) from about 0.05% to about 50% of a surfactant having the following general chemical structure:

$$H(CH_2)_xO(C_3H_6O)_a(C_2H_4O)_bH$$

wherein x is a number from about 1 to about 10, a is a number such that the average molecular weight of the polyoxypropylene portion is from about 1,000 to about 1,500, and b is a number such that the average molecular weight of the polyoxyethylene portion is from about 40% to about 75% of the average molecular weight of said surfactant; and
(c) water.

2. The antibacterial cleansing product of claim 1 comprising from about 1% to about 5% of said salt of chlorhexidine.

3. The antibacterial cleansing product of claim 2 comprising from about 10% to about 30% of said surfactant.

4. The antibacterial cleansing product of claim 3 wherein x is a number from about 2 to about 6.

5. The antibacterial cleansing product of claim 3 wherein x is a number of about 4.

6. The antibacterial cleansing product of claim 4 wherein said salt of chlorhexidine is the digluconate salt of chlorhexidine.

7. An antibacterial cleansing product comprising:

(a) from about 0.001% to about 10% of a salt of chlorhexidine which is soluble in said product;

(b) from about 0.05% to about 50% of a surfactant having the following general chemical structure;

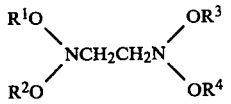

wherein each $R^1$, $R^2$, $R^3$ and $R^4$ group has the following chemical structure:

$$-(C_3H_6O)_c(C_2H_4O)_dH$$

wherein c and d are numbers such that the average molecular weight of the combined polyoxypropylene portions is from about 500 to about 6,000, and such that the average molecular weight of the combined polyoxyethylene portions is from about 20% to about 75% of the average molecular weight of said surfactant; and (c) water.

8. The antibacterial cleansing product of claim 7 comprising from about 1% to about 5% of said salt of chlorhexidine.

9. The antibacterial cleansing product of claim 8 comprising from about 10% to about 30% of said surfactant.

10. The antibacterial cleansing product of claim 9 wherein said salt of chlorhexidine is the digluconate salt of chlorhexidine.

11. The antibacterial cleansing product of claim 9 wherein c is a number such that said total average molecular weight of the polyoxypropylene portion is from about 500 to about 3,500.

* * * * *